United States Patent [19]

Dogadko et al.

[11] Patent Number: 4,641,618

[45] Date of Patent: Feb. 10, 1987

[54] OVERSPEED/OVERHEAT CIRCUIT WITH A LATCH FOR CAPACITIVE IGNITION SYSTEMS

[75] Inventors: Peter Dogadko, Chicago; David Enlow, Wadsworth, both of Ill.

[73] Assignee: Outboard Marine Corporation, Waukegan, Ill.

[21] Appl. No.: 796,088

[22] Filed: Nov. 8, 1985

[51] Int. Cl.[4] ..... F02P 11/00; F02D 31/00; F02B 77/08

[52] U.S. Cl. ..... 123/335; 123/41.15; 123/198 D; 123/198 DC

[58] Field of Search ..... 123/198 D, 198 DC, 335, 123/418, 599, 630, 41.15

[56] References Cited

U.S. PATENT DOCUMENTS

| | | | |
|---|---|---|---|
| 3,158,143 | 11/1964 | Heidner | 123/148 |
| 3,430,615 | 3/1969 | Chavis | 123/102 |
| 3,601,103 | 8/1971 | Swiden | 123/198 D X |
| 3,863,616 | 2/1975 | Wood | 123/148 |
| 3,875,915 | 4/1975 | Anderson et al. | 123/118 |
| 3,993,031 | 11/1976 | Schmaldienst et al. | 123/118 |
| 4,038,951 | 8/1977 | Schweikart | 123/102 |
| 4,074,665 | 2/1978 | Patis | 123/102 |
| 4,155,341 | 5/1979 | Fernquist et al. | 123/148 CC |
| 4,218,998 | 8/1980 | Hill et al. | 123/335 |
| 4,236,494 | 12/1980 | Fairchild | 123/630 |
| 4,297,977 | 11/1981 | Boyama | 123/320 |
| 4,336,778 | 6/1982 | Howard | 123/334 |
| 4,436,076 | 3/1984 | Piteo | 123/198 DC X |
| 4,459,951 | 7/1984 | Tobinaga et al. | 123/198 DC |
| 4,462,356 | 7/1984 | Hirt | 123/335 |
| 4,492,197 | 1/1985 | Yamamoto et al. | 123/630 |
| 4,493,307 | 1/1985 | Trinh et al. | 123/630 |
| 4,510,899 | 4/1985 | Macy | 123/198 D |
| 4,562,801 | 1/1986 | Koike | 123/198 DC X |

FOREIGN PATENT DOCUMENTS

| | | | |
|---|---|---|---|
| 131820 | 8/1982 | Japan | 123/41.15 |
| 126471 | 7/1983 | Japan | 123/335 |

*Primary Examiner*—Tony M. Argenbright
*Attorney, Agent, or Firm*—Michael, Best & Friedrich

[57] ABSTRACT

A circuit protecting against overspeed and overheating in a two-cycle engine having a capacitive discharge ignition system which includes a charging coil in which voltage is induced when a magnet in the flywheel of the engine passes the coil. A rectifier bridge is connected to the coil and a capacitor connected to the bridge. An ignition coil and spark plug are associated with each cylinder of the engine. An electronic switch is associated with each ignition coil and has a trigger which responds to an applied trigger voltage to conduct and discharge the capacitor through the ignition coil. A trigger coil applies a trigger voltage to the triggers. The protective circuit includes a control responsive to engine speed. The control triggers one of the electronic switches to conduct and discharge the capacitor in response to a predetermined response speed. A circuit responsive to operation of an engine temperature responsive switch reduces the predetermined response speed of the control to a lower response speed. The lower response speed is maintained effective even if the engine temperature subsequently falls below the maximum engine temperature. The circuit requires reduction of the engine speed to a speed below the lower response speed in order to restore the response speed of the speed responsive control to the predetermined speed.

12 Claims, 1 Drawing Figure

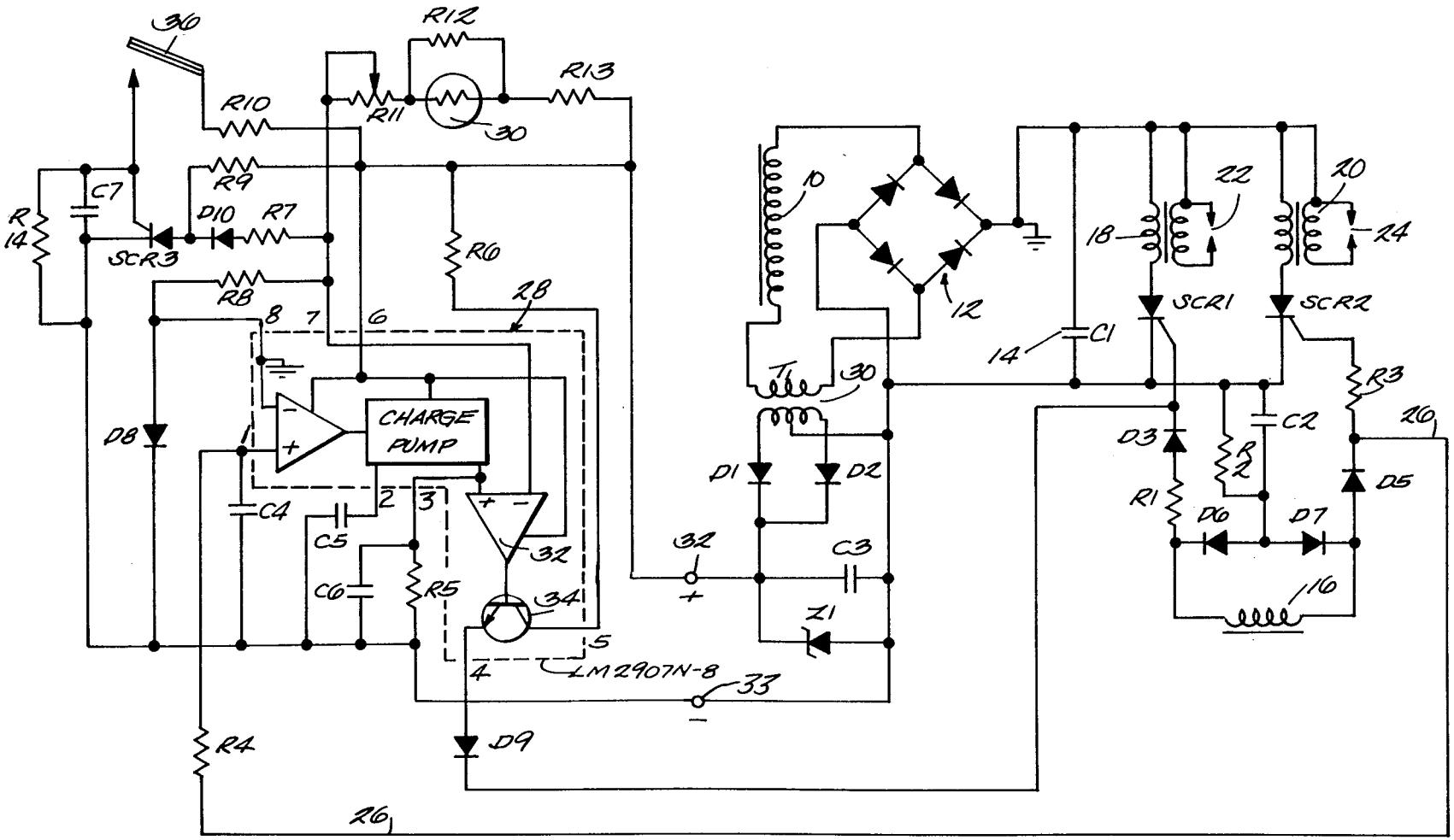
CHARGE PUMP
LM2907N-8
SCR1
SCR2
SCR3

OVERSPEED/OVERHEAT CIRCUIT WITH A LATCH FOR CAPACITIVE IGNITION SYSTEMS

BACKGROUND OF THE INVENTION

This invention relates to provision of means to decrease the speed of an internal combustion engine if the engine overheats. This is broadly old in U.S. Pat. No. 4,459,951 which has a circuit in which a temperature sensing switch is closed when the engine overheats. This causes an oscillator circuit to progressively decrease engine speed to a "safe level." While the patent states that "if the throttle is maintained at its full open position the duty ratio will be held constant so that the engine continues its revolutions at a low speed," the fact is that when the temperature responsive switch opens the engine speed will jump back to full speed. The present invention reduces engine speed when overheat occurs and does not restore engine speed when the heat switch opens . . . this invention requires positive operator action to enable the engine speed to be restored.

In addition to U.S. Pat. No. 4,459,951 attention is directed to the following patents:

| | | |
|---|---|---|
| Wood | 3,863,616 | Feb. 4, 1975 |
| Heidner | 3,158,143 | Nov. 24, 1964 |
| Patis | 4,074,665 | Feb. 21, 1978 |
| Chavis | 3,430,615 | March 4, 1969 |
| Anderson, et al. | 3,875,915 | April 8, 1975 |
| Schmaldienst, et al. | 3,993,031 | Nov. 23, 1976 |
| Howard | 4,336,778 | Jun. 29, 1982 |
| Tobinaga et al. | 4,459,951 | July 17, 1984 |
| Hirt | 4,462,356 | July 31, 1984 |
| Yamamoto et al. | 4,492,197 | Jan. 8, 1985 |
| Trinh, et al. | 4,493,307 | Jan. 15, 1985 |
| Schweikart | 4,038,951 | Aug. 2, 1977 |
| Fernquist et al. | 4,155,341 | May 22, 1979 |
| Hill, et al. | 4,218,998 | Aug. 26, 1980 |
| Fairchild | 4,236,494 | Dec. 2, 1980 |
| Boyama | 4,297,977 | Nov. 3, 1981 |

SUMMARY OF THE INVENTION

This invention provides a two-cycle engine having an ignition circuit and an engine speed responsive control operative to produce a signal, when and as required, to disable the ignition system in response to engine overspeed to thereby limit engine speed to a maximum. A device operative in response to a predetermined engine overheat temperature changes the speed to which the speed responsive control responds to a speed lower than the maximum speed. A latch arrangement is operative to keep the speed to which the speed responsive control responds at such lower speed after the engine temperature falls below the overheat temperature.

Another feature of the invention is that the latch arrangement remains effective until engine speed is reduced to a speed which is still lower than such lower speed. The maximum speed is then restored as the response speed of the speed responsive control.

A further feature of the invention is that the ignition circuit is a capacitive discharge ignition circuit and the speed responsive control includes means responsive to a speed related signal to produce the disabling signal to discharge said capacitive discharge ignition circuit to prevent sparking.

Another improvement is that the latch arrangement is operative to produce a reduced voltage signal which is applied to the speed responsive control to lower the response speed thereof so that the speed responsive input signal must be reduced to one corresponding to the still lower speed in order to terminate production of said intermittent signal.

More specifically the invention is applied to a two-cycle engine having a capacitive discharge ignition circuit including a charging coil in which voltage is induced when a magnet in the flywheel of the engine passes the coil. A rectifier bridge is connected to the coil, and a capacitor is connected to the bridge. An ignition coil and spark plug are associated with each cylinder of the engine. An electronic switch is associated with each ignition coil and has a trigger which is operative in response to an applied trigger voltage signal to cause the switch to conduct and discharge the capacitor through the ignition coil. A trigger coil generates a trigger signal for application to the trigger of the switches. The improvement is a protective circuit comprising a speed limiting control responsive to engine speed to apply to the trigger of one of the switches a disabling signal to cause the switch to conduct and discharge the capacitor in response to a predetermined (maximum) response speed. An engine overheat circuit is responsive to operation of a switch responsive to engine temperature to reduce a reference voltage to reduce the predetermined response speed of the speed limiting control to a lower response speed when the engine temperature exceeds a maximum engine temperature. The lower response speed remains effective even if the engine temperature falls below the maximum engine temperature.

The invention also requires reduction of the engine speed to a speed below the lower response speed to restore the response speed of the speed responsive control to the predetermined speed.

The speed responsive control includes a comparator and a circuit applying a reference voltage to the comparator while the ignition circuit applies a speed related voltage to the comparator. The circuit responsive to operation of the temperature responsive switch is operative to reduce the reference voltage.

BRIEF DESCRIPTION OF THE DRAWING

The single FIGURE is a circuit diagram which follows standard designations and will be described in detail only so far as necessary to understand the operation of the circuit.

This invention is not limited to the details of construction and the arrangement of components set forth in the following description or illustrated in the drawing. The invention is capable of other embodiments and of being practiced and carried out in various ways. Also, it is to be understood that the phraseology and terminology employed herein is for the purpose of description and should not be regarded as limiting.

DETAILED DESCRIPTION OF THE DRAWING

FIG. 1 includes a schematic showing of a two-cylinder capacitive discharge ignition system incorporating an integral 7.5 volt power supply. The overspeed and overheat protection circuit is comprised of a capacitative discharge (CD) ignition circuit, a power supply circuit and an overspeed limiting and temperature overheat RPM limiting circuit. The CD ignition circuit is conventional and known in the art. It generally includes a primary capacitor and capacitor charging circuit, spark plug circuits for each of two cylinders, trigger signal means, and an ignition circuit responsive to signals from the trigger signal means to discharge the primary capacitor through the appropriate spark plug circuit to cause ignition. More specifically, the ignition circuit has a charge coil 10 in which voltage is induced as a magnet in a rotating flywheel passes the coil. This voltage is applied to a full wave rectifier bridge 12 and the rectified voltage is applied to the primary storage capacitor 14. The two cylinders are provided with a spark plug 22, 24 on the secondary of ignition transformers 18, 20. The primary capacitor 14 is discharged through the primary of transformer 18 or 20 when the associated SCR 1 or SCR 2 is triggered by trigger signal means. The rotating flywheel induces voltage in the trigger coil or sensor 16 to produce a trigger signal in SCR 1 or SCR 2 to discharge the storage capacitor 14 via ignition coils 18, 20 to fire the engine spark plugs 22, 24.

The power supply circuit comprises a current transformer 30 in series with the charge coil 10. It also includes a full wave rectification scheme utilizing diodes Dl and D2 with a filter capacitor C3 and Zener diode Dl to provide a 7.5 volt voltage supply across junctions 32, 33.

The overspeed and temperature overheat RPM limiting circuit is connected to the output from the trigger signal means and is speed responsive and outputs a disabling signal to the ignition circuit to trigger SCR 1 in the ignition circuit in order to prevent charging the capacitor 14 and thereby prevent sparking at the plugs. Thus the output of coil 16 is connected to SCR 2 via resistance R3 and there is a branch lead 26 connected to input 1 on the integrated circuit 28 via resistance R4. Integrated circuit 28 is a frequency to voltage (F/V) converter (LM2907N-8) connected in the speed switch mode and powered by the power supply circuit. Input 1 is a tachometer signal input; that is, it receives the trigger signal induced in coil 16. This signal is indicative of speed. The F/V converter is configured as a speed switch which compares the trigger signal at pin 1 to a reference voltage at pin 8 from the reference voltage circuit and which outputs a disabling signal at pin 4 to the trigger of SCR 1 in the ignition circuit when the trigger signal converted to a DC voltage exceeds the reference voltage. Diode D3 connected between the gate of SCR 1 and the trigger coil 16 and diode D9 connected between the F/V converter and the gate of SCR 1 permit SCR 1 to be triggered either from the trigger coil 16 or from the output pin 4 from the F/V converter 28.

The drawing shows the internal connections for the F/V converter 28. Pin 8 is internally grounded and the output of the input stage is applied to a charge pump with capacitor C5 as the main factor in converting the frequency into a DC voltage. The filter capacitor C6 integrates the charge pulses to provide a DC voltage at pin 3 on the plus side of the internal comparator 32. The negative input to the comparator 32 is set by the reference voltage on pin 7 which is derived from the voltage divider R13, R12 in parallel with thermistor 30 and the potentiometer Rll and the fixed resistance 8. When the voltage on pin 3 reaches the preset at pin 7, the voltage comparitor 32 is high and so is the output pin 4 which is the output from the transitor 34. The output on pin 4 is an intermittent signal (as and when required) and is used to externally trigger the SCR 1 and thus discharge the storage capacitor 14 and render the ignition circuit inoperative. The potentiometer Rll is trimmed to set the speed at which the ignition will be disabled. Initially, the ignition will be disabled to cut out one cylinder and as the speed reaches or exceeds the preset limit, both cylinders will be cut out.

The overheat circuit is connected to the power supply circuit and reduces the voltage at pin 7 from the standard reference voltage circuit when the temperature of the engine exceeds a predetermined value. Further, the overheat circuit keeps the voltage at the reduced value until the engine speed is reduced below a predetermined level. More particularly, the overheat circuit comprises a temperature sensitive bimetal switch 36 which closes when a predetermined engine temperature is reached, and an electronic switching device SCR 3 which is switched on by the closing of the temperature sensitive switch and which then remains conductive so long as current passes through the electronic switching device. More particulary, closure of switch 36 causes a positive voltage to be applied from terminal 32 through resistor R10 and the temperature switch 36 to the gate of SCR 3. This triggers SCR 3 which is then "latched" or kept in a conductive state by the network comprised of resistance R9, and resistance R7 and diode D10, connected in parallel with the resistance R8 and diode D8 between pin 7 of the converter 28. Latching SCR 3 in the conductive state reduces the bias voltage on pin 7 which results in a much lower speed cut-out point depending on the value of the R7 resistance (approximately 2500 RPM is the desired point). The reduced bias may be considered a latching signal.

The electronic switching device obtains current from the power supply circuit. Above a predetermined RPM, the power supply, which obtains power form the primary capacitor charging circuit as described above, has sufficient power to power the F/V converter 28 and produce the disabling signal. When the engine is operating below a preselected RPM, 900 RPM in this instance, the power supply is reduced by operation of the F/V converter and the power supply voltage drops to about 4 volts. This lower supply voltage is insufficient to maintain the latching current necessary to keep the electronic switching device SCR 3 conductive, so it is turned off and the overheat circuit no longer reduces the reference voltage.

From this it is clear that when the engine overheats the engine speed is cut to about 2500 RPM and the overheat system is latched on and remains latched regardless of the temperature switch condition, i.e., if the temperature switch 36 opens, the system stays latched until the power supply voltage level falls to about 4 volts at pin 3 which is approximately 900 rpm. To have the speed drop this low, it is necessary for the operator to manually decrease the throttle to approximately idle conditions. That will permit the "latch" to open (SCR 3 becomes non-conductive) and restore the system to the normal operation. Now the engine speed can be increased above the 2500 rpm limit. This requirement for conscious manual action prevents unexpected increase in speed following disabling of the ignition system on overheating. As noted above, in the prior art an overheat condition will reduce the speed, but when the overheat terminates the speed is restored abruptly. This can be unexpected and can result in damage or injury.

If this invention is applied to outboard motors having more than two cylinders, it may be appropriate to use the boat's batteries for the power supply.

We claim:

1. An engine ignition system including, engine speed responsive means operative to produce a signal to disable said ignition system in response to an engine speed greater than a predetermined maximum to thereby limit engine speed to such maximum, temperature responsive means operative in response to a predetermined engine overheat temperature to change the speed to which said speed responsive means responds to a speed lower than said maximum speed, and latch means operative to keep the speed to which said speed responsive means responds at said lower speed upon removal of said overheat temperature.

2. An engine ignition system according to claim 1 in which said latch means remains effective until engine speed is reduced to a speed which is still lower than said lower speed, said maximum speed being thereafter restored as the speed to which said speed responsive means responds.

3. An engine ignition system according to claim 2 in which said ignition system is a capacitive discharge ignition system and said speed responsive means includes means responsive to a speed related signal to produce said disabling signal to discharge said capacitive discharge ignition system to prevent sparking.

4. An engine ignition system according to claim 3 in which said latch means is operative to produce a signal which is applied to said speed responsive means to lower the speed to it responds to said lower speed.

5. An engine ignition system according to claim 4 in which said speed responsive signal must be reduced to one corresponding to said still lower speed in order to terminate production of said disabling signal.

6. A two-cycle engine having ignition means associated with each cylinder, including, means responsive to engine speed and operative in response to a predetermined maximum speed to disable said ignition means when and as required to prevent engine speed exceeding said predetermined maximum speed, means responsive to engine temperature and operative to reduce the speed to which said means responsive to engine speed responds to a speed lower than said maximum speed whereby the speed of said engine is prevented from going above said lower speed when the engine temperature reaches a predetermined maximum temperature and, latch means responsive to operation of said temperature responsive means to continue said lower speed as the speed to which said engine speed responsive means responds even if the engine temperature is subsequently lowered and also being operative to require the engine speed to be reduced to an even lower speed following reduction of engine temperature below said predetermined maximum in order to disable said latch means.

7. A control for preventing overspeed and overheating of a two-cycle engine having an ignition circuit, comprising, engine overspeed limiting means responsive to engine speed and operative to disable said ignition circuit as and when required to prevent the speed of the engine from exceeding said predetermined maximum speed, engine temperature overheat limiting means responsive to engine temperature and operative in response to a predetermined maximum temperature to disable said ignition circuit as and when required to prevent the engine speed from exceeding a speed lower than said predetermined maximum speed but at which lower speed the engine can safely operate under overheating conditions, and latch means operative upon operation of said temperature limiting means to continue said lower speed as the response speed of said speed limiting means even after engine temperature is reduced below said predetermined maximum.

8. The combination with a two-cycle engine having a capacitive discharge ignition system including, a charging coil in which voltage is induced when a magnet in the flywheel of the engine passes the coil, a rectifier bridge connected to said coil, a capacitor connected to said bridge, an ignition coil and spark plug associated with each cylinder of the engine, electronic switch means associated with each said ignition coil and having a trigger which is operative in response to an applied trigger voltage to cause said switch means to conduct and discharge said capacitor through said ignition coil, and a trigger coil operative to generate a trigger voltage for application to the trigger of each said switch means, of protective circuit means comprising, means responsive to engine speed to apply to one of said triggers a voltage to cause said one switch means to conduct and discharge said capacitor in response to a predetermined response speed, switch means responsive to engine temperature, circuit means responsive to operation of said engine temperature responsive switch means to reduce said predetermined response speed to a lower response speed when the engine temperature exceeds a maximum engine temperature, and means to maintain said lower response speed effective even if the engine temperature falls below said maximum engine temperature.

9. The combination of claim 8 including means responsive to reduction of said engine speed to a speed below said lower response speed to restore the response speed of said speed responsive means to said predetermined speed if said temperature responsive switch means has become inoperative.

10. The combination of claim 9 in which said engine speed responsive means includes a comparator, circuit means applying a reference voltage to said comparator, and means applying a speed related voltage to said comparator, said circuit means responsive to operation of said switch means being operative to reduce said reference voltage.

11. A control for preventing overheating of an engine having an ignition system, comprising, engine temperature responsive means operative in response to a predetermined maximum temperature to disable said ignition system when and as required to prevent the engine speed from exceeding a predetermined maximum speed at which the engine can safely operate under overheating conditions, and latch means operative upon operation of said temperature responsive means to continue said maximum speed as the maximum engine speed even after engine temperature is reduced below said predetermined maximum.

12. A control according to claim 11 including means requiring reduction of engine speed to a lower speed to render said latch means inoperative.

* * * * *